US012352485B2

(12) United States Patent
Taras

(10) Patent No.: US 12,352,485 B2
(45) Date of Patent: Jul. 8, 2025

(54) SYSTEMS AND METHODS FOR HEAT PUMP SYSTEMS

(71) Applicant: Daikin Comfort Technologies Manufacturing, L.P., Waller, TX (US)

(72) Inventor: Michael F. Taras, Spring, TX (US)

(73) Assignee: Daikin Comfort Technologies Manufacturing, L.P., Waller, TX (US)

( * ) Notice: Subject to any disclaimer, the term of this patent is extended or adjusted under 35 U.S.C. 154(b) by 330 days.

(21) Appl. No.: 17/821,934

(22) Filed: Aug. 24, 2022

(65) Prior Publication Data

US 2024/0068724 A1 Feb. 29, 2024

(51) Int. Cl.

| | |
|---|---|
| ***F25B 49/02*** | (2006.01) |
| ***F25B 13/00*** | (2006.01) |
| ***F25B 41/20*** | (2021.01) |

(52) U.S. Cl.

CPC ..... *F25B 49/022* (2013.01); *F25B 13/00* (2013.01); *F25B 41/20* (2021.01)

(58) Field of Classification Search

CPC ..... F25B 49/022; F25B 41/20; F25B 13/00
See application file for complete search history.

(56) References Cited

U.S. PATENT DOCUMENTS

| | | | | |
|---|---|---|---|---|
| 2002/0124592 | A1 | 9/2002 | Takeuchi et al. | |
| 2008/0041079 | A1 | 2/2008 | Nishijima et al. | |
| 2009/0320506 | A1* | 12/2009 | Lifson | F25B 41/385 62/197 |
| 2020/0124326 | A1* | 4/2020 | Kumakura | F25B 13/00 |

FOREIGN PATENT DOCUMENTS

| | | | |
|---|---|---|---|
| CN | 111023363 | A * | 4/2020 |
| CN | 210242068 | U | 4/2020 |
| CN | 216993812 | U | 7/2022 |
| JP | 2007333280 | A * | 12/2007 |
| JP | 2009270785 | A * | 11/2009 |
| JP | 2022110661 | A * | 7/2022 |
| KR | 2020100006350 | U | 6/2010 |

OTHER PUBLICATIONS

Aoki et al., Refrigerating Cycle Device, Nov. 19, 2009, JP2009270785A, Whole Document (Year: 2009).*
Wang et al., Air Conditioner and Control Method, Apr. 17, 2020, CN111023363A, Whole Document (Year: 2020).*

(Continued)

*Primary Examiner* — Larry L Furdge
(74) *Attorney, Agent, or Firm* — K&L Gates LLP

(57) ABSTRACT

A heat pump heating, ventilation, and air conditioning (heat pump HVAC) system is operable to use a refrigerant to heat or cool an indoor space with a refrigerant circuit performing a reversible vapor compression cycle between an outdoor heat exchanger and an indoor heat exchanger. The heat pump HVAC system includes an ejector in fluid communication with the refrigerant circuit. The refrigerant circuit includes a first flow of refrigerant upstream from the outdoor heat exchanger and a second flow of refrigerant downstream from the outdoor heat exchanger; and the ejector is configurable to combine the first flow and the second flow into a combined flow, at least a portion of which is returned to the compressor.

11 Claims, 6 Drawing Sheets

(56) References Cited

OTHER PUBLICATIONS

Kawamura, Air Conditioner, Jul. 29, 2022, JP2022110661A, Whole Document (Year: 2022).*
Nakajima, Ejector Type Refrigeration Device, Dec. 27, 2007, JP2007333280A, Whole Document (Year: 2007).*
International Search Report and Written Opinion dated Nov. 14, 2023 for PCT Patent Application No. PCT/US2023/070892 filed on Jul. 25, 2023.

* cited by examiner

SYSTEMS AND METHODS FOR HEAT PUMP SYSTEMS

BACKGROUND

This section is intended to provide relevant background information to facilitate a better understanding of the various aspects of the described embodiments. Accordingly, these statements are to be read in this light and not as admissions of prior art.

A heat pump is a refrigerant system that is typically operable in both cooling and heating modes. While air conditioners are familiar examples of heat pumps, the term "heat pump" is more general and applies to many heating, ventilating, and air conditioning ("HVAC") devices used for space heating or space cooling. A cold climate heat pump ("CCHP") is a heat pump specially designed for use in cold outdoor temperatures and can provide mechanical air heating utilizing a refrigerant vapor compression cycle or a combination of mechanical air heating and electrical resistance or combustion heating. The US Department of Energy specifies that 5 F CCHPs are capable of heat pump operation down to at least 5 F (−15 C) ambient temperature, and −15 F CCHPs are capable of heat pump operation down to at least −15 F (−26 C).

In a cooling mode, a heat pump operates like a typical air conditioner, i.e., a refrigerant flows through an HVAC circuit where the refrigerant is compressed in a compressor and delivered to a condenser (or an outdoor heat exchanger). In the condenser, heat is exchanged between a medium such as outside air, water, or the like and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled. When a heat pump is used for heating, it employs the same basic refrigeration-type cycle used by an air conditioner or a refrigerator, but refrigerant flows through the HVAC circuit in the opposite direction, releasing heat into the conditioned space rather than the surrounding environment. In this use, heat pumps generally draw heat from cooler external air, water, or from the ground.

Reversible heat pumps (generally referred to herein simply as "heat pumps") work in either direction to provide heating or cooling to the internal space as mentioned above. Reversible heat pumps employ a reversing, or four-way, valve to reverse the flow of refrigerant from the compressor through the condenser and evaporation coils. In heating mode, the outdoor coil is an evaporator, while the indoor coil is a condenser. The refrigerant flowing from the evaporator (outdoor coil) carries the thermal energy from outside air (or source such as water, soil, etc.) indoors. Vapor temperature is augmented within the pump by compressing it. The indoor coil then transfers thermal energy (including energy from the compression) to the indoor air, which is then moved around the inside of the building by an air handler. The refrigerant is then allowed to expand, cool, and absorb heat from the outdoor environment in the outside evaporator, and the cycle repeats.

For a constant amount of compressor work input, a pressure difference between the input and the output of the compressor is constant. The compressor operation thus increases the enthalpy of the refrigerant by a constant magnitude, between the upper and lower pressures of the compressor. Thus the pressure and temperature difference of the refrigerant (e.g., an operational range) between the indoor and outdoor heat exchangers is set by the upper and lower pressures of the compressor in a standard heating and cooling refrigeration cycle. With a set operational range, the lower limit temperature for the outdoor heat exchanger is thus also limited and the use of the heat pump system is limited to outdoor temperatures greater than or equal to the outdoor heat exchanger temperature. However, the use of heat pump systems is increasingly desirable in colder and colder environments, and thus a need exists for systems and methods that allow for an expansion of the operational range between the indoor and outdoor heat exchangers. Additionally, a need exists for systems and methods that can be used to improve compressor energy efficiency. Recognizing these needs, the US Department of Energy launched a CCHP Technology Challenge in 2021 to accelerate innovation, development, and commercialization of 5 F CCHP and −15 F CCHP technologies.

SUMMARY

Some embodiments disclosed herein are directed to a heat pump heating, ventilation, and air conditioning (heat pump HVAC) system operable to use a refrigerant to heat or cool an indoor space. In an embodiment, the heat pump HVAC system includes a compressor, an outdoor heat exchanger, an indoor heat exchanger, a first expansion device, and a four-way valve connected together as a refrigerant circuit. The four-way valve is configurable to direct refrigerant flow through the first expansion device in a first direction in a cooling mode and in a second direction, opposite the first direction, in a heating mode. Additionally, an ejector is in fluid communication with the refrigerant circuit. When the heat pump HVAC system is in the heating mode, the refrigerant circuit includes a first flow of refrigerant upstream from the outdoor heat exchanger and a second flow of refrigerant downstream from the outdoor heat exchanger. Additionally, the ejector is configurable to combine the first flow and the second flow into a combined flow, at least a portion of which is returned to the compressor.

Other embodiments disclosed herein are directed to a method of operating a heat pump HVAC system operable to use a refrigerant to heat an indoor space in a heating mode or cool an indoor space in a cooling mode. The method includes compressing the refrigerant with a compressor, flowing the refrigerant in a refrigerant circuit including an indoor heat exchanger, a first expansion device, and an outdoor heat exchanger. The refrigerant flows through the first expansion device in a first direction in the cooling mode and in a second direction, opposite the first direction, in the heating mode. The method further including flowing a first flow of refrigerant upstream from the outdoor heat exchanger in the heating mode, flowing a second flow of refrigerant downstream from the outdoor heat exchanger in the heating mode, combining the first flow and the second flow into a combined flow within an ejector in the heating mode, and flowing at least a portion of the combined flow to the compressor in the heating mode.

Still other embodiments disclosed herein are directed to a heat pump HVAC system operable to use a refrigerant to heat or cool an indoor space and including a compressor, an outdoor heat exchanger, an indoor heat exchanger, a first expansion device, and a four-way valve connected together as a refrigerant circuit. The four-way valve is configurable to direct the refrigerant flow through the first expansion device in a first direction in a cooling mode and in a second direction, opposite the first direction, in a heating mode. Additionally, an ejector is in fluid communication with the refrigerant circuit; and an internal heat exchanger is thermally coupling a first flow of refrigerant upstream from the outdoor heat exchanger and a second flow of refrigerant downstream from the outdoor heat exchanger when in the heating mode.

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure are described below. In an effort to provide a concise description of these embodiments, not all features of an actual implementation may be described. It should be appreciated that in the development of any such actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The present disclosure relates to heat pump heating, ventilating, and air conditioning ("heat pump HVAC") systems using an ejector. More particularly the disclosure relates to systems and methods of using an ejector to improve the heat pump HVAC system thermal performance in a heating mode and expanding an operational envelope with respect to ambient temperatures. While heat pump HVAC systems are discussed, it should also be appreciated that the concepts are also applicable to refrigeration systems.

Figure 1:
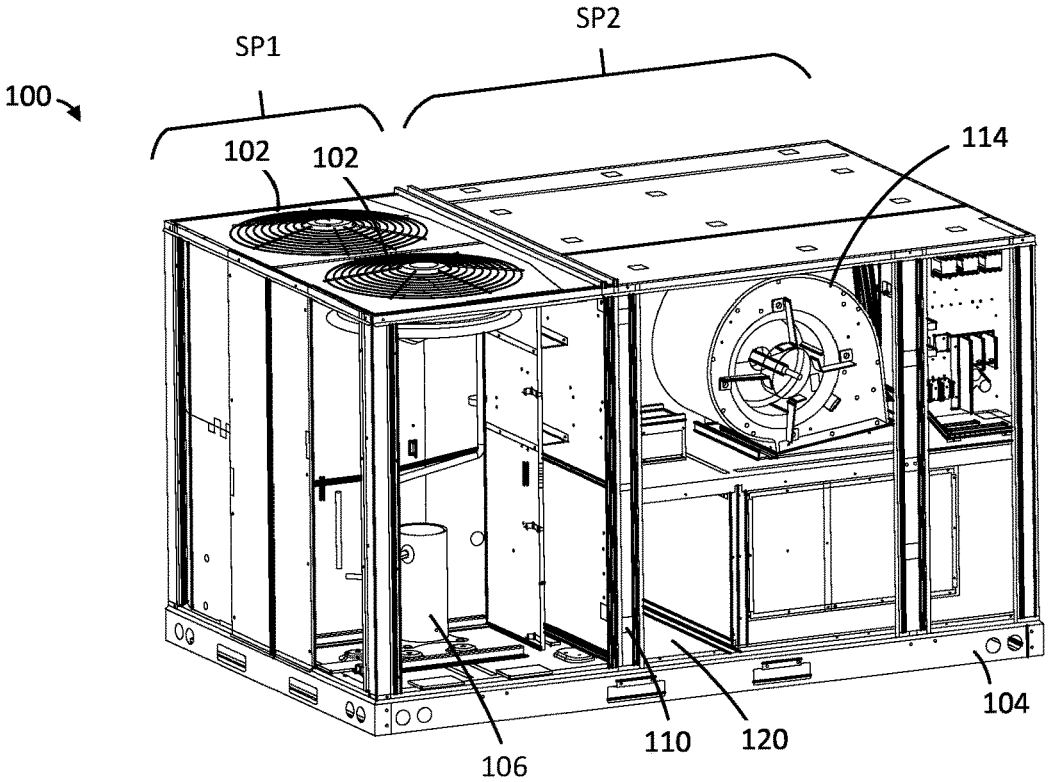
FIG. 1 is a partial isometric view of a heat pump HVAC system, according to one or more embodiments.
Figure 2:
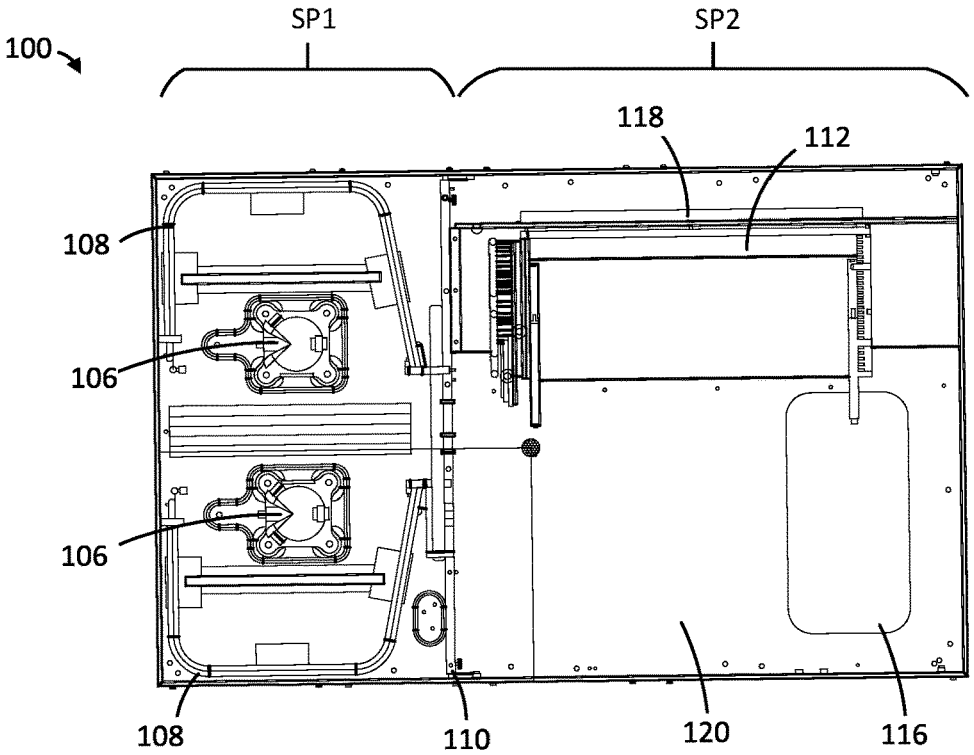
FIG. 2 is sectioned top view of the heat pump HVAC system of FIG. 1.
Figure 3:
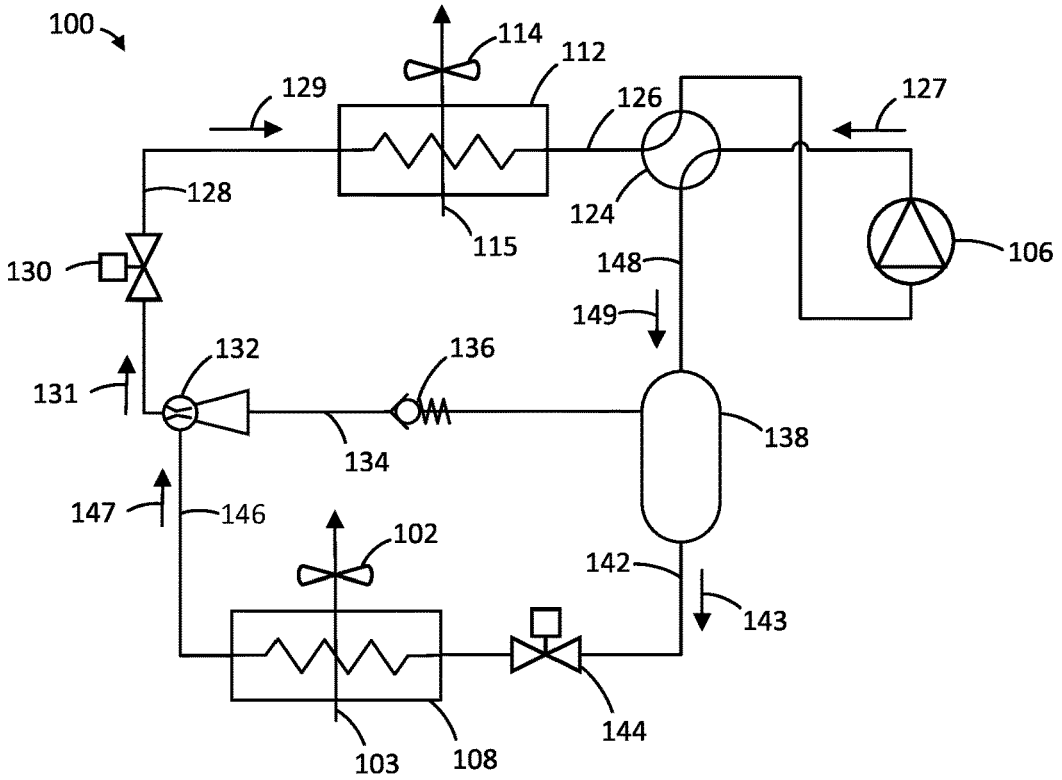
FIG. 3 is a schematic view of a heat pump HVAC system in a cooling mode of operation, according to one or more embodiments.

Referring now to FIGS. 1-3, a heat pump HVAC system 100 is shown in a partial isometric view, a top view, and a schematic view, respectively. Some components of the heat pump HVAC system 100 have been removed from FIGS. 1 and 2 for clarity. Although not shown, it should be appreciated that the heat pump HVAC system 100 includes additional components such as panel covers for covering and protecting the equipment of the heat pump HVAC system 100. The example heat pump HVAC system 100 is a "light" commercial packaged rooftop unit. The heat pump HVAC system 100 includes both an "outdoor" section SP1 and an "indoor" section SP2 mounted on a common frame 104. However, the heat pump HVAC system 100 may also represent residential packaged, residential split, light commercial split, or commercial applied applications as well as refrigeration system applications. The heat pump HVAC system 100 may be a variable refrigerant flow system with variable speed outdoor fans 102.

As shown in FIG. 2, the outdoor section SP1 includes one or more compressors 106, which may be any suitable type. (e.g., fixed speed, two speed, variable speed, etc.) Without limitation, the outdoor section SP1 may also include other HVAC system components, such as accumulators, receivers, charge compensators, flow control devices, air movers, pumps, and filter driers secured within and attached to the structure of the heat pump HVAC system 100. Also included are one or more outdoor heat exchangers 108 and outdoor fans 102 that move air into the outdoor section SP1 across the outdoor heat exchanger 108 and to the outside of the heat pump HVAC system 100. The outdoor fans 102 may be any suitable type of fan, for example, a propeller fan. The outdoor heat exchangers 108 are not shown in in FIG. 1 for clarity. However FIG. 2 includes two outdoor heat exchangers 108 curved along a perimeter of the outdoor section SP1. The outdoor heat exchangers 108 may include a plurality of heat-transfer tubes, in which a refrigerant flows, and a plurality of heat-transfer fins (not shown), in which air flows between gaps thereof. The plurality of heat-transfer tubes may be arranged in an up-down direction (herein referred to as "row direction"), and each heat-transfer tube may extend in a direction substantially orthogonal to the up-down direction (in a substantially horizontal direction). Without limitation, the heat-transfer tubes of the outdoor heat exchanger 108 are connected to each other along end portions via U-shape return bends that allow flow of the refrigerant from a certain column to another column and/or a certain row to another row. The plurality of heat-transfer fins, which extend in the up-down direction, are arranged side by side with a predetermined interval between the plurality of heat-transfer fins. The plurality of heat-transfer fins and the plurality of heat-transfer tubes are assembled to each other so that each heat-transfer fin extends through the plurality of heat-transfer tubes. Alternatively, the plurality of heat-transfer fins may also be disposed in a plurality of columns.

Due to the structure of the outdoor heat exchangers 108, operation of the outdoor fans 102 draws an outdoor airflow 103 into the outdoor section SP1 and passes through the outdoor heat exchangers 108. As the outdoor air passes through the outdoor heat exchangers 108 the outdoor airflow 103 exchanges thermal energy with the refrigerant that flows in the outdoor heat exchangers 108. After the thermal energy exchange in the outdoor heat exchanger 108, the air is then also discharged to the outside of the outdoor section SP1 by the outdoor fans 102. Even though the outdoor heat exchanger 108 is described as a round tube and plate fin heat exchanger, other heat exchanger types, such as for instance a microchannel heat exchanger, are within the scope of the disclosure.

The outdoor section SP1 and the indoor section SP2 are separated by a partition plate 110. Outdoor airflow 103 passes into the outdoor section SP1 and an indoor airflow 115 passes into the indoor section SP2. By separating the outdoor section SP1 and the indoor section SP2 by the partition plate 110, the airflow bypass between the outdoor section SP1 and the indoor section SP2 is blocked. Therefore, in an ordinary state, the indoor airflow 115 and the outdoor airflow 103 do not mix and do not communicate with each other within or via the heat pump HVAC system 100. It should be noted, that airside economizers allow mixing indoor and outdoor air, however they are not discussed in relation to this disclosure.

The indoor section SP2 also includes an indoor heat exchanger 112 and a blower 114, which may be, for example, a centrifugal fan. The indoor section SP2 may also optionally include a combustion heat exchanger (not shown). The indoor heat exchanger 112 may also include a plurality of heat-transfer tubes, in which a refrigerant flows, and a plurality of heat-transfer fins, in which air flows between gaps thereof. The plurality of heat-transfer tubes may be arranged in an up-down direction (row direction), and each heat-transfer tube may extend in a direction substantially orthogonal to the up-down direction. Without limitation, the heat-transfer tubes of the indoor heat exchanger 112 are connected to each other along end portions via U-shape return bends that allow flow of the refrigerant from a certain column to another column and/or a certain row to another row. The plurality of heat-transfer fins and the plurality of heat-transfer tubes may be assembled so that each heat-transfer fin extends through the plurality of heat-transfer tubes. Although the indoor heat exchanger 112 is described as a round tube and plate fin heat exchanger, other heat exchanger types, such as for instance a microchannel heat exchanger, are within the scope of this disclosure.

The indoor heat exchanger 112 divides the indoor section SP2 into spaces upstream and downstream with respect to the indoor airflow 115 passing through the indoor heat exchanger 112. The blower 114 is disposed in the space on the downstream side of the indoor heat exchanger 112 and operation of the blower 114 imparts the indoor airflow 115 through the indoor heat exchanger 112 and thus between a return air opening 118 and a supply air opening 116 which each lead to indoor spaces (not shown) to be conditioned. In this manner, a looped circuit of airflow is established between the indoor spaces and the indoor heat exchanger 112. Although the return air opening 118 and the supply air opening 116 are formed through a bottom plate 120 in the example of FIGS. 1 and 2, side-oriented passages are also feasible.

Figure 4:
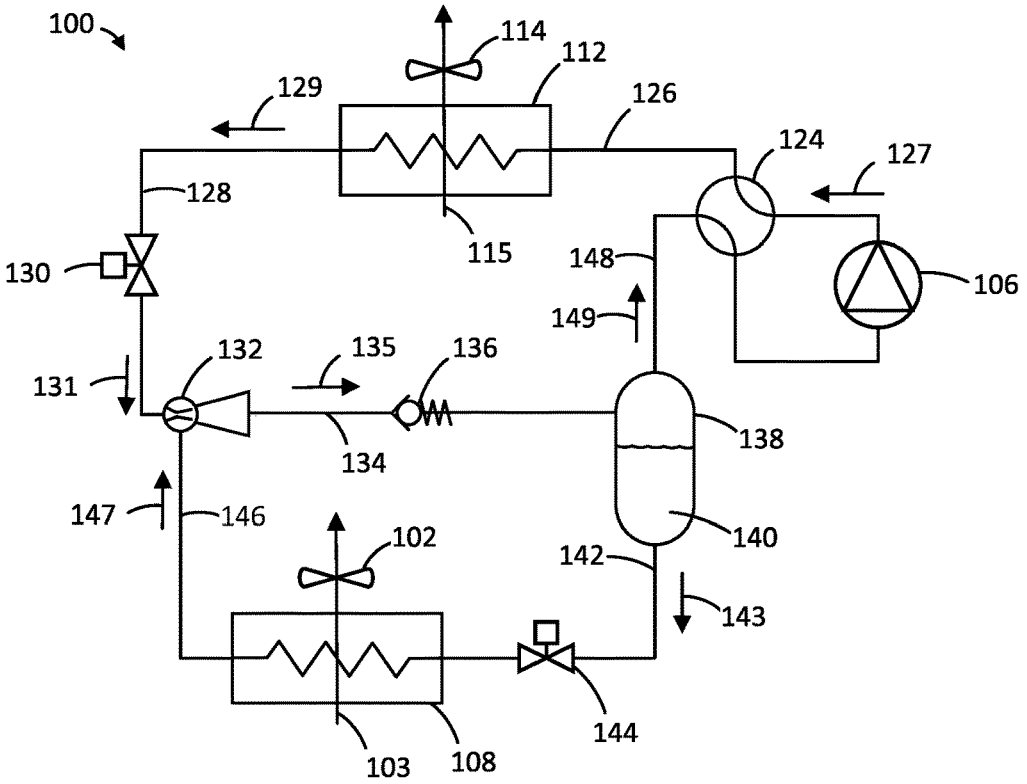
FIG. 4 is a schematic view of the heat pump HVAC system of FIG. 3 in a heating mode of operation.

FIGS. 3 and 4 depict a heat pump HVAC system 100. In general, when in a cooling mode and a heating mode of operation, a refrigerant circuit circulates the refrigerant to perform a vapor compression refrigeration cycle, whereby heat is exchanged at the indoor heat exchanger 112 and at the outdoor heat exchangers 108. The direction of heat transfer for the heat exchangers 112, 108 is reversed between the cooling and heating modes of operation.

The heat pump HVAC system 100 of FIG. 3 depicts a cooling mode of operation. The heat pump HVAC system 100 also includes a refrigerant circuit that recirculates a refrigerant between the indoor heat exchanger 112 and the outdoor heat exchanger 108. The refrigerant circuit includes the compressor 106, a configurable four-way valve 124, the indoor heat exchanger 112, an expansion device 130, an ejector 132, a check valve 136, a separation tank 138, the outdoor heat exchanger 108, an expansion device 144, and various lines as detailed herein to connect the components of the refrigerant circuit. In the cooling mode, the refrigerant is compressed by the compressor 106 to increase an enthalpy of the refrigerant. A flow 127 of the compressed refrigerant flows through the four-way valve 124, through a line 148 via a flow 149, and to the separation tank 138. In the cooling mode of operation, the separation tank 138 acts as a pass-through for the refrigerant.

Downstream of the separation tank 138, the refrigerant then flows in a line 142 via a flow 143 to the expansion device 144. Substantially all of the flow 149 is directed to the flow 143. The check valve 136 restricts flow from the pressurized separation tank 138 through a line 134. In the cooling mode of operation, the expansion device 144 is fully open and thus does not change the velocity or pressure of the refrigerant flowing therein. Alternatively, the bypass with the on/off solenoid valve around the expansion valve 144 can be arranged, if desired. The refrigerant then flows into the outdoor heat exchanger 108, where heat is exchanged with the outdoor environment via an outdoor airflow 103 established by the outdoor fan 102. In the cooling mode, the refrigerant within the outdoor heat exchanger 108 may be hotter than the outdoor environment. In that case, heat is transferred away from the refrigerant and the enthalpy is reduced as part of the vapor compression cycle.

After the outdoor heat exchanger 108, the refrigerant is sent through a line 146 via a flow 147 to the ejector 132, and then into a line 128 via a flow 131 out of the ejector 132. If desired, the bypass with the on/off solenoid valve can be arranged around the ejector 132. The ejector 132 is also connected to the refrigerant circuit at a third position via the line 134. Each of the lines 128, 134, 146 are in fluid communication through internal orifices within the ejector 132, but substantially all of the flow 147 is directed into the flow 131 because the check valve 136 is spring loaded (or otherwise biased) to a closed position with a set pressure difference across the check valve 136. As described, the line 134 has less or substantially equal pressures between the ejector 132 and the separation tank 138 and the biased check valve 136 is normally closed when the heat pump HVAC system 100 is in the cooling mode. The expansion device 130 is installed along the line 128 and expands the flow 131 of the refrigerant therein, causing a reduced pressure, a reduced temperature, and an associated increased volumetric flow rate as shown by a flow 129 downstream of the expansion device 130. The expanded and cooled refrigerant of the flow 129 then passes through the indoor heat exchanger 112 to exchange heat with the indoor airflow 115 established by the blower 114. The enthalpy of the refrigerant is increased as the refrigerant is heated, and the air cooled by the indoor heat exchanger 112 is supplied to the indoor space or environment being conditioned. After the heat exchange at the indoor heat exchanger 112, the refrigerant is evaporated into a gaseous state and then travels back through a line 126, the four-way valve 124, and is then sucked back into the compressor 106 to repeat the cycle. The expansion device 130 may be replaced by two unidirectional expansion devices, one dedicated to a cooling mode of operation and the other to a heating mode of operation. Optionally, the ejector 132 may also include a valve operable to selectively allow the flow 147 into the flow 131 or a valve to selectively allow flow along the line 134. Thus, the check valve 136 may be omitted while still maintaining the functionality described. Optionally, the separation tank 138 may be placed between the four-way valve 124 and the compressor 106 without departing from the principles described herein.

FIG. 4 depicts the heat pump HVAC system 100 in a heating mode of operation. In the heating mode, the refrigerant is again compressed by the compressor 106 to increase an enthalpy of the refrigerant. The flow 127 of the compressed refrigerant is sent through the four-way valve 124 to the indoor heat exchanger 112 via the line 126. The refrigerant dissipates heat at the indoor heat exchanger 112 to the indoor airflow 115 that is supplied to the indoor space or environment being conditioned. After the heat exchange at the indoor heat exchanger 112, the enthalpy of the refrigerant is decreased. The refrigerant is sent via the line 128 and the flow 129 to the expansion device 130. At the expansion device 130, the refrigerant expands which reduces a pressure and temperature of the refrigerant. The refrigerant is then transferred as the flow 131 into the ejector 132. Narrowed orifices within the ejector 132 focus and accelerate the flow 131 and further reduce the refrigerant pressure within the ejector 132. The reduced pressure becomes useful to suck in, entrain, and thus mix flows of low pressure and low temperature refrigerant from the flow 147 within the line 146, as discussed below. The orifices within the ejector 132 then expand the mixed refrigerants to reduce the refrigerant velocity and increase the pressure and temperature.

The pressure within the line 134 is greater than the biased pressure setting of the check valve 136 and a combined flow 135 transfers the refrigerant into the separation tank 138. At some operating conditions, the pressure and temperature within the separation tank 138 results in a gas phase of the refrigerant at the top of the separation tank 138 and a liquid phase 140 of the refrigerant that is condensed and accumulated at the bottom of the separation tank 138. The liquid phase 140 then flows via the line 142 as the flow 143 through the expansion device 144. The expansion device 144 expands the flow 143 of the refrigerant therein, causing a reduced pressure, a reduced temperature, and an associated increased volumetric flow rate as shown by the flow 147 downstream of the expansion device 144.

The expanded and cooled refrigerant then passes through the outdoor heat exchanger 108 and absorbs heat from the outdoor environment via the outdoor airflow 103 to increase the enthalpy of the refrigerant. The pressure and temperature of the refrigerant within the line 146 are less than the pressure and temperature of the refrigerant feeding the ejector via the line 128, however the operation of the ejector 132 still allows mixing and combination of the flows 131, 147. As previously described, the accelerated flow and the associated pressure drop within the ejector 132 creates a lower pressure within the orifice of the ejector 132 that is used to suck in, entrain, and mix the flow 147 with the flow 131 of refrigerant. In this manner, the flow 131, which has a relatively higher pressure upstream of the ejector 132, is mixed with the lower pressure flow 147, and the resulting combined flow 135 has a relatively intermediate enthalpy that is between the enthalpy of the flows 131, 147 leading into the ejector 132.

By creating an intermediate enthalpy for the combined flow 135, the flow 149 that returns to the compressor 106 has a higher enthalpy than if the flow 147 returned directly to the compressor 106. Thus, by using the ejector 132, the work input energy of the compressor 106 is less to return the enthalpy of the refrigerant to the initial compressed condition, relative to the work input energy required to compress the flow 147 to the initial compressed condition. Stated alternatively, for a constant amount of compressor 106 work input, a pressure difference between the input (line 148) and the output (line 126) is constant. Operation of the compressor 106 thus increases the enthalpy of the refrigerant by a constant magnitude, between the upper and lower pressures of the compressor 106. The pressure and temperature difference (e.g., an operational range) between the heat exchangers 108, 112 is set by the upper and lower pressures of the compressor 106 in a standard heating and cooling refrigeration cycle. However, the operational range between the heat exchangers 108, 112 can be expanded by using the ejector 132 arrangement. For example, the outdoor heat exchanger 108 can be operated at a lower pressure (and hence at a lower temperature) than the pressure of the flow 149 into the compressor 106, because the ejector 132 will maintain the needed pressure of the flow 149 by blending the flows 131, 147 in the manner previously described. By lowering the operational pressure and temperature of the outdoor heat exchanger 108, greater enthalpy gains are achieved as more heat energy is absorbed by the refrigerant in the outdoor heat exchanger 108. Additionally, a lower temperature for the outdoor heat exchanger 108 also allows the use of the heat pump HVAC system 100 in colder environments because heat transfer is still possible when the outdoor heat exchanger 108 is colder than the outdoor ambient temperature. In an example, the heat pump HVAC system 100 may be classified as a cold climate heat pump ("CCHP"), where the outdoor heat exchanger 108 has an operational range down to at least 5 F (−15 C) ambient temperature. Alternatively the heat pump HVAC system 100 is a CCHP, where the outdoor heat exchanger 108 has an operational range down to at least −15 F (−26 C) ambient temperature. It should be pointed out that in the heating mode of operation, the refrigerant system 100 can operate as a conventional system, bypassing the ejector 132 while the expansion device 144 is fully open or bypassed. Furthermore, the defrosting or deicing the outdoor heat exchanger 108 in the cold environments can be done by one of the known methods (e.g. reversing the vapor compression cycle, hot gas bypass, etc.).

Figure 5:
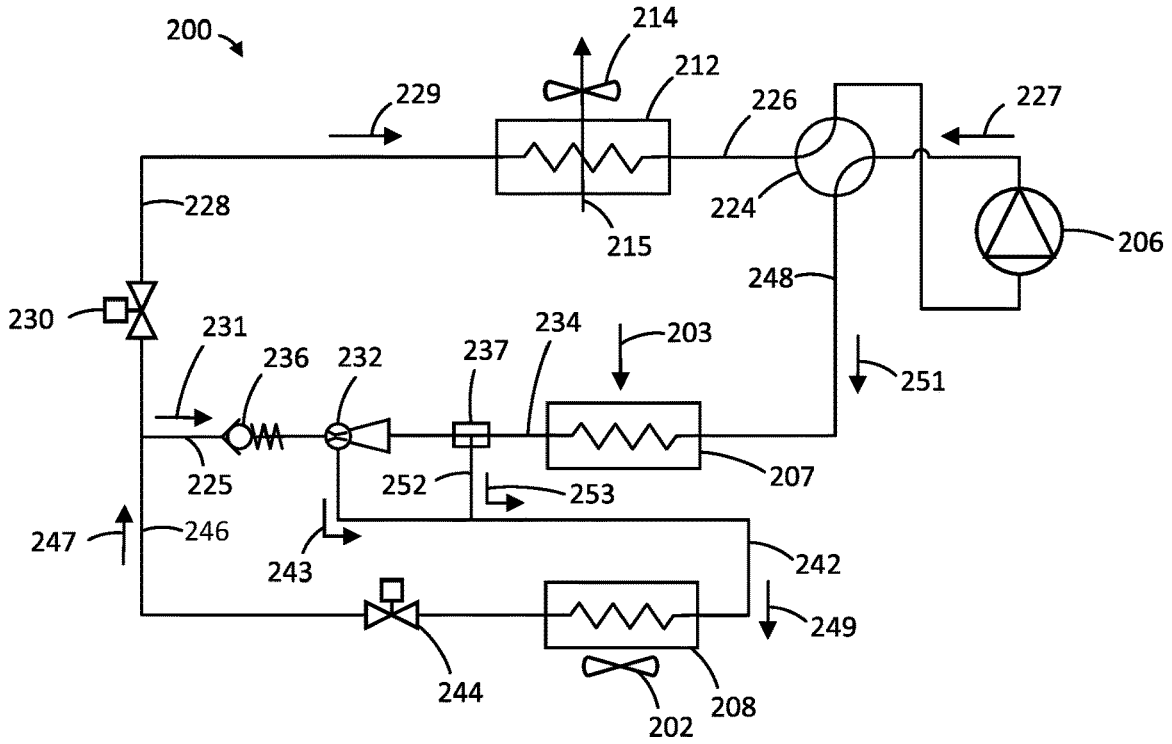
FIG. 5 is a schematic view of a heat pump HVAC system in a cooling mode of operation, according to one or more embodiments.
Figure 6:
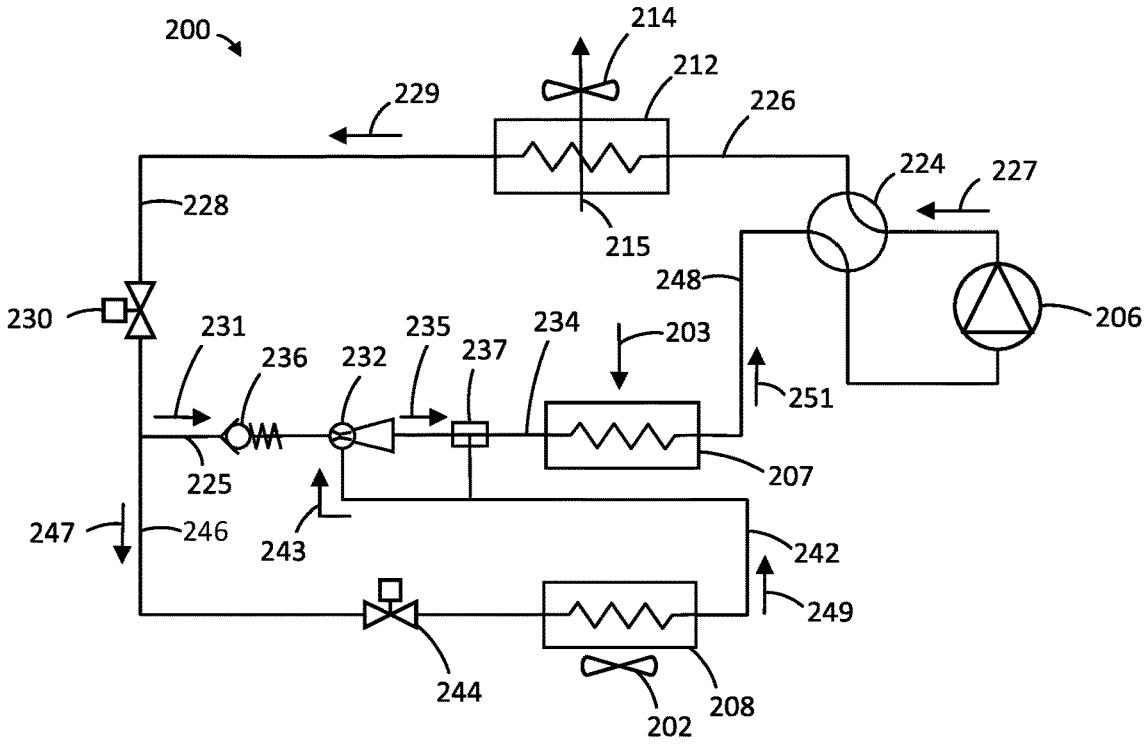
FIG. 6 is a schematic view of the heat pump HVAC system of FIG. 5 in a heating mode of operation.

FIGS. 5 and 6 depict a heat pump HVAC system 200. In general, when in a cooling mode and a heating mode of operation, the refrigerant circuit circulates the refrigerant to perform a vapor compression refrigeration cycle, whereby heat is exchanged at the indoor heat exchanger 212 an offset heat exchanger 207, and an outdoor heat exchanger 208. The direction of heat transfer for the heat exchangers 212, 207, 208 is reversed between the cooling and heating modes of operation. In general, some components and the refrigeration circuit of the heat pump HVAC system 200 are similar to the components and refrigerant circuit of the heat pump HVAC system 100, and thus the same or similar reference numerals are used. Accordingly, such features will not be described again in detail, except as necessary for the understanding of the heat pump HVAC system 200.

The heat pump HVAC system 200 of FIG. 5 depicts a cooling mode of operation. The refrigerant circuit of the heat pump HVAC system 200 recirculates a refrigerant between the indoor heat exchanger 212, the offset heat exchanger 207, and the outdoor heat exchanger 208. The refrigerant circuit includes a compressor 206, a configurable four-way valve 224, the indoor heat exchanger 212, an optional expansion device 230, an ejector 232, a check valve 236, an optional three-way valve 237, the offset heat exchanger 207, an expansion device 244, the outdoor heat exchanger 208, and various lines as detailed herein to connect the components of the refrigerant circuit. In the cooling mode, the refrigerant is compressed by the compressor 206 to increase an enthalpy of the refrigerant. A flow 227 of the compressed refrigerant is sent through the four-way valve 224, through a line 248 via a flow 251, and to the offset heat exchanger 207. The flow of the refrigerant within the offset heat exchanger 207 exchanges heat with the outdoor environment via an outdoor airflow 203 established by an outdoor fan 202. In the cooling mode, the refrigerant within the offset heat exchanger 207 is hotter than the outdoor environment and thus heat is transferred away from the refrigerant and the enthalpy of the refrigerant is reduced as part of the vapor compression cycle.

After the offset heat exchanger 207, the refrigerant is sent through a line 234 via the flow 251 to the ejector 232 and then into a line 242 via a flow 243 out of the ejector 232. The flows 251, 243 are substantially equal as the ejector 232 may be configured to not substantially restrict or change the pressure or velocity between the flows 251, 243. The ejector 232 is also connected to the refrigerant circuit at a third position via a line 225, however the check valve 236 restricts flow along the line 225. Optionally, the three-way valve 237 may be included along the line 234 to direct a bypass flow 253 of the refrigerant to the line 242, while blocking the flow 251, and thus bypassing the ejector 232. The three-way valve 237 may include larger internal flow passages than the ejector 232, and thus bypassing the ejector 232 via the three-way valve 237 can allow higher volumetric flowrates of refrigerant while having lower pressure drops. Alternatively, the three-way valve 237 may be replaced by a solenoid valve (not shown) along the bypass line 252.

The refrigerant within the line 242 passes through the outdoor heat exchanger 208 as shown by a flow 249 and exchanges heat with the outdoor airflow 203. As heat energy is removed from the refrigerant, the enthalpy of the refrigerant is further reduced. Thus, in the cooling mode of operation the offset heat exchanger 207 is in series with and upstream from the outdoor heat exchanger 208 relative to the outdoor airflow 203 and the heat exchangers 207, 208 both reduce the enthalpy of the refrigerant as part of the vapor compression cycle. The expansion device 244 installed along a line 246 then expands refrigerant, causing a reduced pressure, a reduced temperature, and an associated increased volumetric flow rate as shown by a flow 247 downstream of the expansion device 244. The expanded and cooled refrigerant of the flow 247 then passes through the optional expansion device 230, which is fully open and thus does not change the velocity or pressure of the refrigerant flowing therein.

The refrigerant continues along a line 228 and as a flow 229 that passes through the indoor heat exchanger 212 to exchange heat with an indoor airflow 215 established by a blower 214. The enthalpy of the refrigerant is increased as it is heated, and the air cooled by the indoor heat exchanger 212 is supplied to the indoor space or environment being conditioned. After the heat exchange at the indoor heat exchanger 212, the refrigerant is evaporated into a gaseous state and then travels back through a line 226, the four-way valve 224, and is then sucked back into the compressor 206 to repeat the cycle. Optionally, the expansion device 244 can be replaced by two unidirectional expansion devices, one dedicated to a cooling mode of operation and the other to a heating mode of operation. Also optionally, the expansion device 230 may also be omitted. Also optionally, an accumulator (not shown) may be placed between the four-way valve 224 and the compressor 206 to ensure separation of gaseous and liquid phases of the returned refrigerant.

The heat pump HVAC system 200 of FIG. 6 depicts a heating mode of operation. The refrigerant is compressed by the compressor 206 to increase an enthalpy of the refrigerant. The flow 227 of the compressed refrigerant is sent through the four-way valve 224 to the indoor heat exchanger 212 via the line 226. The refrigerant dissipates heat at the indoor heat exchanger 212 to the indoor airflow 215 that is supplied to the indoor space or environment being conditioned. The indoor heat exchanger 212 reduces the enthalpy of the refrigerant. After the heat exchange the refrigerant flows in the line 228 via the flow 229 to the expansion device 230. The expansion device 230 expands the refrigerant as the flow 247 within the line 246 and the pressure and temperature of the refrigerant are reduced. Optionally, the expansion device 230 may be omitted and the pressure and temperature of the refrigerant in the lines 228, 246 may be equal.

If the pressure within the line 246 is greater than the biased pressure setting of the check valve 236, refrigerant flows in the line 225 via a flow 231 to the ejector 232. The biased pressure of the check valve 236 may be set to achieve the desired flow rate of the flow 231 to the ejector 232. Optionally, the expansion device 230 (when included) and the expansion device 244 may be controlled to establish the pressure difference across the check valve 236 and the thus control the amount of the flow 231 into the ejector 232.

The flow 247 transfers the refrigerant through the expansion device 244 that expands the refrigerant and reduces the pressure and temperature of the refrigerant for heat exchange in the outdoor heat exchanger 208 via the outdoor airflow 203 established by the outdoor fan 202. In the heating mode, the refrigerant within the outdoor heat exchanger 208 is typically colder than the outdoor environment and thus heat may be transferred into the refrigerant and the enthalpy is increased.

The refrigerant is then transferred in the line 242 as the flow 249 into the ejector 232. In the heating mode, the optional three-way valve 237 (when included, or substituted by an on/off solenoid valve, as discussed above) is closed to the line 242, and thus substantially all of the flow 249 is directed into the flow 243 and into the ejector 232. Narrowed orifices within the ejector 232 focus and accelerate the flow 231 and reduce the refrigerant pressure within the ejector 232. The pressure of the refrigerant in the flow 243 is less than the pressure of the refrigerant in the flow 231, however the operation of the ejector 232 still allows mixing and combination of the flows 231, 243. As previously described, the accelerated flow and associated pressure drop within the ejector 232 creates a lower pressure within the orifice of the ejector 232 that may suck in, entrain, and mix the flows 231, 243. In this manner, the flow 231, which has a relatively higher pressure upstream of the ejector 232, is mixed with the lower pressure flow 243, and a resulting combined flow 235 has a relatively intermediate enthalpy that is between the enthalpy of the flows 231, 243 leading into the ejector 232. The combined flow 235 then flows through the offset heat exchanger 207 and exchanges heat with the outdoor airflow 203 in the manner described for the outdoor heat exchanger 208.

By creating an intermediate enthalpy for the combined flow 235, the flow 251 that returns to the compressor 206 is at a higher enthalpy than if the flow 243 returned to the compressor 206. Thus by using the ejector 232 as described, the work input energy of the compressor 206 is less to return the enthalpy of the refrigerant to the initial compressed condition, relative to the work input energy required to compress the flow 243 to the initial compressed condition. Stated alternatively, for a constant amount of compressor 206 work input, a pressure difference between the input (line 248) and the output (line 226) is constant. The compressor 206 operation thus increases the enthalpy of the refrigerant by a constant magnitude, between the upper and lower pressures of the compressor 206. The pressure and temperature difference (e.g., an operational range) between the heat exchangers 208, 212 is set by the upper and lower pressures of the compressor 206 in a standard heating and cooling refrigeration cycle. However, the operational range between the heat exchangers 208, 212 can be expanded by using the ejector 232 arrangement described. For example, the outdoor heat exchanger 208 can be operated at a lower pressure (and hence at a lower temperature) than the pressure of the flow 251 into the compressor 206, because the ejector 232 will maintain the needed pressure of the flow 251 by blending the flows 231, 243 in the manner previously described. By lowering the operational pressure and temperature of the outdoor heat exchanger 208, greater enthalpy gains are achieved as more heat energy is absorbed by the refrigerant.

Additionally, a lower temperature for the outdoor heat exchanger 208 also allows the use of the heat pump HVAC system 200 in colder environments because heat transfer is still possible when the outdoor heat exchanger 208 is colder than the outdoor ambient temperature. In an example, the heat pump HVAC system 200 is classified as a CCHP, where the outdoor heat exchanger 208 has an operational range down to at least 5 F (−15 C) ambient temperature. Alternatively, the heat pump HVAC system 200 is a CCHP, where the outdoor heat exchanger 208 has an operational range down to at least −15 F (−26 C) ambient temperature. Still further, the use of the offset heat exchanger 207 downstream of the ejector 232 may be an advantage relative to only using the outdoor heat exchanger 208 because the offset heat exchanger 207 reduces the possibility of the compressor 206 flooding by assuring all-vapor conditions along the line 248 returning the refrigerant to the compressor 206. Thus the inclusion of the offset heat exchanger 207 may increase the compressor 206 operational reliability. Furthermore, the inclusion of the offset heat exchanger 207 may also allow for improved or simplified defrosting operation. The in-series arrangement with the outdoor heat exchanger 208, relative to the outdoor airflow 203, may result in all or a majority of the frost formation on the offset heat exchanger 207 rather than the outdoor heat exchanger 208. As the outdoor airflow 203 passes across the offset heat exchange 207, a predominant amount of moisture contained in the air will be removed by the offset heat exchanger 207, leaving a lower humidity content in the outdoor airflow 203 passing across the outdoor heat exchanger 208. It should be pointed out that in the heating mode of operation, the refrigerant system 200 can optionally operate by bypassing the ejector 232 by blocking the flow 231 via the check valve 236 or a solenoid valve (not shown) along the line 225. When bypassing the ejector 232, the three-way valve 237 may also be used to flow the refrigerant along the line 252 via the bypass flow 253.

Figure 7:
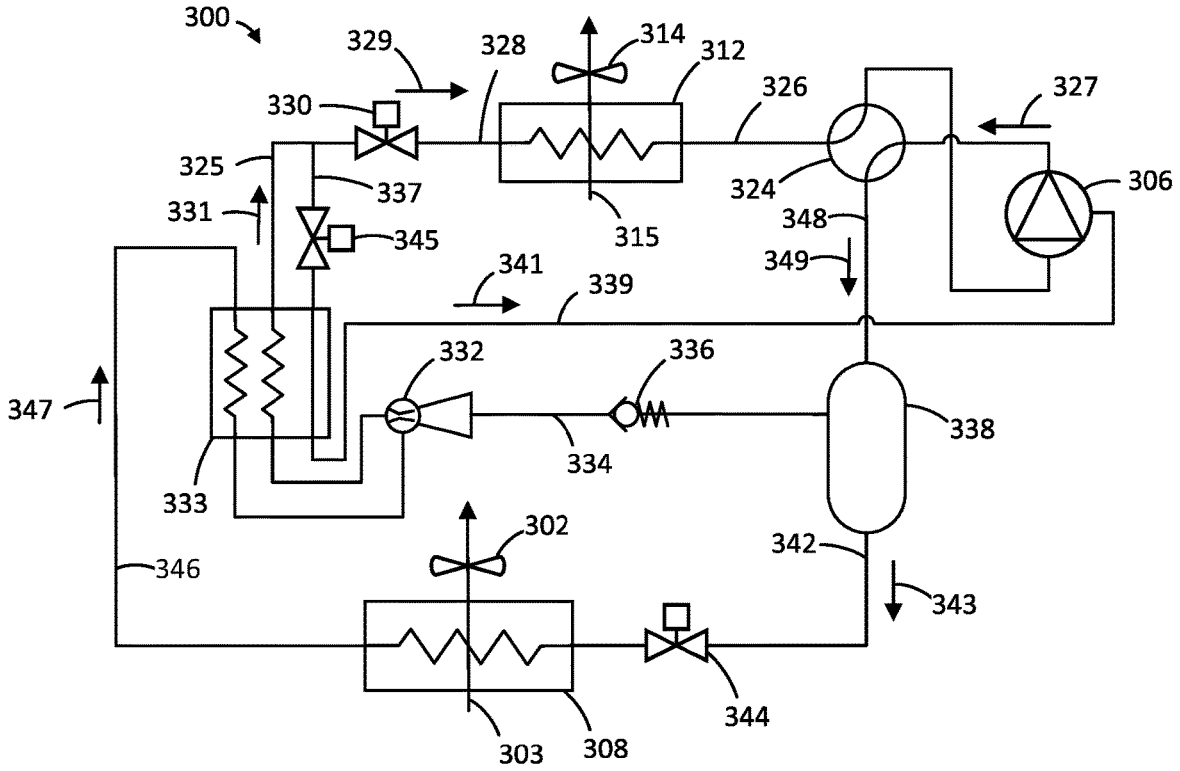
FIG. 7 is a schematic view of a heat pump HVAC system in a cooling mode of operation, according to one or more embodiments.
Figure 8:
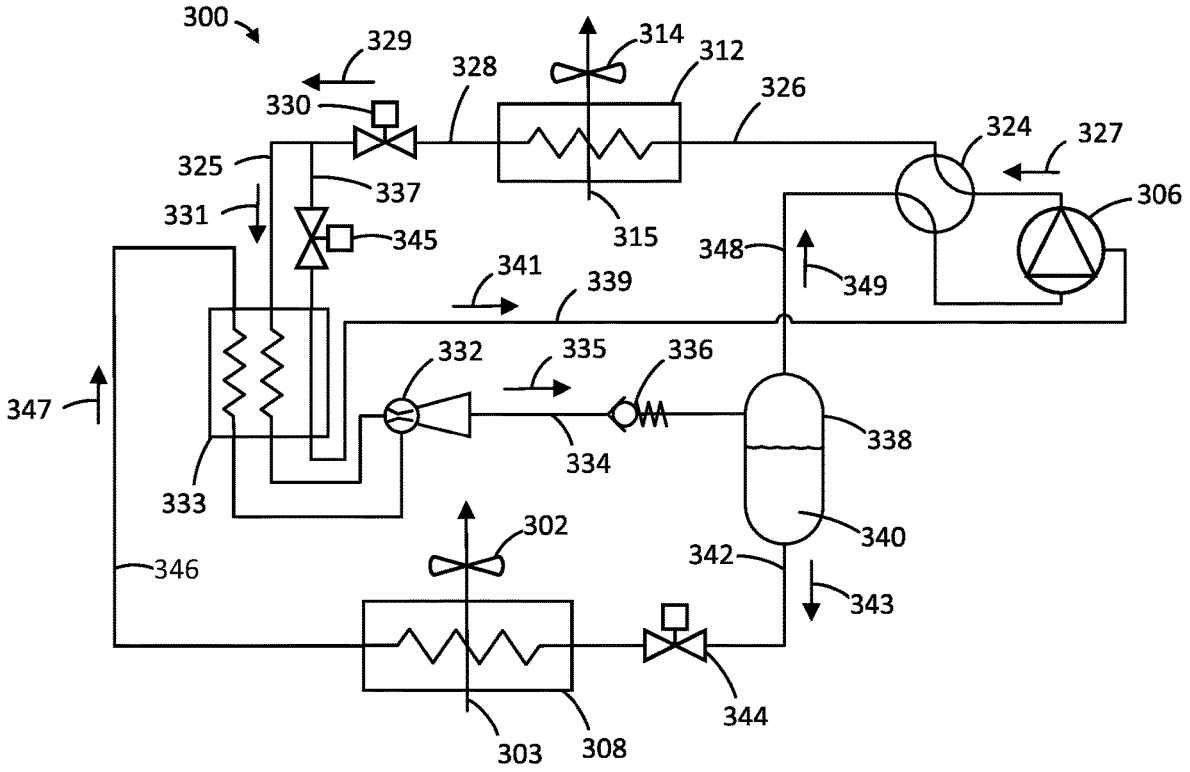
FIG. 8 is a schematic view of the heat pump HVAC system of FIG. 7 in a heating mode of operation.

FIGS. 7 and 8 depict a heat pump HVAC system 300. In general, when in a cooling mode and a heating mode of operation, the refrigerant circuit circulates the refrigerant to perform a vapor compression refrigeration cycle, whereby heat is exchanged at the indoor heat exchanger 312 and an outdoor heat exchanger 308. The direction of heat transfer for the heat exchangers 312, 308 is reversed between the cooling and heating modes of operation. In general, some components and the refrigeration circuit of the heat pump HVAC system 300 are similar to the components and refrigerant circuit of the heat pump HVAC system 100, and thus the same or similar reference numerals are used. Accordingly, such features will not be described again in detail, except as necessary for the understanding of the heat pump HVAC system 300. As described further herein the heat pump HVAC system 300 includes an internal heat exchanger 333 that is used in the cooling and heating modes to transfer heat into a vapor injection line 339 and to a compressor 306. In addition, the internal heat exchanger 333 may also be configured, in the heating mode, to transfer heat between a line 325 and a line 346, which leads into an ejector 332.

The heat pump HVAC system 300 of FIG. 7 depicts a cooling mode of operation. The refrigerant circuit of the heat pump HVAC system 300 recirculates a refrigerant between the indoor heat exchanger 312 and the outdoor heat exchanger 308. The refrigerant circuit includes a compressor 306, a configurable four-way valve 324, an indoor heat exchanger 312, an expansion device 330, a vapor line expansion device 345, the internal heat exchanger 333, an ejector 332, a check valve 336, a separation tank 338, an outdoor heat exchanger 308, an expansion device 344, and various lines as detailed herein to connect the components of the refrigerant circuit. In a cooling mode, the refrigerant is compressed by the compressor 306 to increase an enthalpy of the refrigerant. A flow 327 of the compressed refrigerant is sent through the four-way valve 324, through a line 348 via a flow 349 and to the separation tank 338. In the cooling mode of operation, the separation tank 338 acts merely as a pass-through for the refrigerant.

Downstream of the separation tank 338, the refrigerant then flows in a line 342 via a flow 343 to an expansion device 344. Substantially all of the flow 349 is directed to the flow 343. The check valve 336 restricts flow from the pressurized separation tank 338 through a line 334. In the cooling mode of operation, the expansion device 344 is fully open and thus does not change the velocity or pressure of the refrigerant flowing therein. The refrigerant then flows into the outdoor heat exchangers 308, where heat is exchanged with the outdoor environment via an outdoor air flow 303 established by an outdoor fan 302. In the cooling mode, the refrigerant within the outdoor heat exchanger 308 is hotter than the outdoor environment. Thus, heat is transferred away from the refrigerant and the enthalpy of the refrigerant is reduced as part of the vapor compression cycle.

After the outdoor heat exchanger 308, the refrigerant flows through a line 346 via a flow 347, through the internal heat exchanger 333, through the ejector 332, and then into a line 325 via a flow 331 out of the ejector 332. The lines 325, 346 are thermally coupled by the internal heat exchanger 333 (e.g., by using counter flow, parallel flow, or combinations thereof through a common thermally conductive material) such that heat may be transferred between the lines 325, 346. However, during the cooling mode of operation, the flow through the ejector 332 does not substantially change the pressure or the temperature of the refrigerant, thus the lines 325, 346 are at substantially the same temperature and minimal heat is transferred therebetween in the internal heat exchanger 333. The ejector 332 is also connected to the refrigerant circuit at a third position via a line 334, but substantially no flow of refrigerant is passed within the line 334 because the check valve 336 is spring loaded (or otherwise biased) to a closed position. The line 334 is downstream of the expansion device 344 and thus has lower pressure than the separation tank 338. Therefore, the check valve 336 is also closed in the cooling mode due to a pressure differential across the check valve 336.

Referring again to the line 325, downstream of the internal heat exchanger 333, the flow 331 of refrigerant flows through the expansion device 330 installed along a line 328 and expands the refrigerant therein. The expansion of the refrigerant causes a reduced pressure, a reduced temperature, and an associated increased flow rate as shown by a flow 329 downstream of the expansion device 330. The expanded and cooled refrigerant of the flow 329 then passes through the indoor heat exchanger 312 to exchange heat with an indoor airflow 315 established by a blower 314. The enthalpy of the refrigerant is increased as the refrigerant is heated and the air cooled by the indoor heat exchanger 312 is supplied to the indoor space or environment being conditioned. After the heat exchange at the indoor heat exchanger 312, the refrigerant is evaporated into a gaseous state and then travels back through a line 326, the four-way valve 324, and is then sucked back into the compressor 306 to repeat the cycle.

Optionally, the expansion device 330 can be replaced by two unidirectional expansion devices, one dedicated to a cooling mode of operation and the other to a heating mode of operation. Optionally, the vapor line expansion device 345 may also be coupled to the line 325 at a position upstream of the expansion device 330. When the vapor line expansion device 345 is opened, the refrigerant from a line 337 is reduced in pressure and temperature as the refrigerant is expanded into a vapor injection flow 341 via a vapor injection line 339. The pressure and temperature of the refrigerant in the vapor injection line 339 is between the pressures and temperatures of the compressor 306 inlet and outlets via lines 326, 348. The vapor injection line 339 is thermally coupled with the lines 325, 346 via the internal heat exchanger 333 and thus heat is transferred between lines 325, 346 and the vapor injection line 339.

The vapor injection flow 341 is then supplied to the compressor 306 for internal mixing with the flow 329 of refrigerant downstream of the indoor heat exchanger 312. The enthalpy of the refrigerant of the vapor injection flow 341 is greater than the enthalpy of the refrigerant of the flow 329. Thus less work input energy is needed by the compressor 306 to return the refrigerant to the initial conditions for the flow 327. In this manner, an operational range between the heat exchangers 308, 312 is expanded as previously described.

Optionally, the ejector 332 may also include a valve operable to selectively allow the flow 347 to be combined into the flow 331 or a valve to selectively allow flow along the line 334. Thus, the check valve 336 may optionally be omitted while still maintaining the functionality described. Optionally, the separation tank 338 may be placed between the four-way valve 324 and the compressor 306 without departing from the principles described herein.

The heat pump HVAC system 300 of FIG. 8 depicts a heating mode of operation. The refrigerant is compressed by the compressor 306 to increase an enthalpy and pressure of the refrigerant. The flow 327 of the compressed refrigerant is sent through the four-way valve 324 to the indoor heat exchanger 312 via the line 326. The refrigerant dissipates heat at the indoor heat exchanger 312 to the indoor airflow 315 that is supplied to the indoor space or environment being conditioned.

After the heat exchange at the indoor heat exchanger 312, the enthalpy of the refrigerant is decreased and the refrigerant is sent via the line 328 and the flow 329 to the expansion device 330. The expansion device 330 is fully open in the heating mode and thus does not change the pressure or temperature of the refrigerant flow 329 along the line 328.

The refrigerant the flows in the line 325 via the flow 331 through the internal heat exchanger 333 and into the ejector 332. Narrowed orifices within the ejector 332 focus and accelerate the flow 331 and reduce the refrigerant pressure within the ejector 332. The reduced pressure becomes useful to suck in, entrain, and thus mix flows of low pressure and low temperature refrigerant from the flow 347 within the line 346, as discussed below. The orifices within the ejector 332 expand to reduce the refrigerant velocity and increase the pressure and temperature. The pressure within the line 334 is greater than the biased pressure setting of the check valve 336 and a combined flow 335 transfers the refrigerant into the separation tank 338.

At some operating conditions, the pressure and temperature within the separation tank 338 results in a gas phase of the refrigerant at the top of the separation tank 338 and a liquid phase 340 of the refrigerant that is condensed and accumulated at the bottom of the separation tank 138. The liquid refrigerant 340 then flows via the line 342 as the flow 343 through the expansion device 344. The expansion device 344 expands the flow 343 of the refrigerant therein, causing a reduced pressure, a reduced temperature, and an associated increased volumetric flow rate as shown by the flow 347 downstream of the expansion device 344.

The expanded and cooled refrigerant then passes through the outdoor heat exchanger 308 and absorbs heat from the outdoor environment via the outdoor air flow 303 to increase the enthalpy of the refrigerant. The line 346 and the flow 347 then pass through the internal heat exchanger 333 and the refrigerant absorbs heat and enthalpy from the higher temperature refrigerant flowing in the line 325. Therefore, the heat exchange by the internal heat exchanger 333 also cools (e.g., "precools") the flow 331 of refrigerant in the line 325 before the refrigerant enters the ejector 332. The pressure of the refrigerant within the line 346 is less than the pressure of the refrigerant within the line 325, however the operation of the ejector 332 still allows mixing and combination of the flows 331, 347. As previously described, the accelerated flow and associated pressure drop within the ejector 332 creates a lower pressure within the orifice of the ejector 332 that is used to suck in, entrain, and mix the flow 347 with the flow 331 of refrigerant. In this manner, the flow 331, which has a relatively higher pressure upstream of the ejector 332, is mixed with the lower pressure flow 347, and the resulting combined flow 335 has a relatively intermediate enthalpy that is between the enthalpy of the flows 331, 347 leading into the ejector 332. By creating an intermediate enthalpy for the combined flow 335, the flow 349 that returns to the compressor 306 is at a higher enthalpy than if the flow 347 returned directly to the compressor 306. Thus, by using the ejector 332 as described, the work input energy of the compressor 306 is less to return the enthalpy of the refrigerant to the initial compressed condition, relative to the work input energy required to compress the flow 347 to the initial compressed condition. Similarly, the use of the optional vapor injection line 339 may raise the enthalpy of the refrigerant within the compressor 306 so that less work input energy is needed. Optionally, the three-stream internal heat exchanger 333 can be replaced by two two-stream heat exchangers (not shown), one to transfer heat between the refrigerant flows 347 and 331 and the other to transfer heat between the refrigerant flow 331 and the vapor injection flow 341.

As previously described, for a constant amount of compressor 306 work input, a pressure difference between the input (line 348) and the output (line 326) is constant. The compressor 306 operation thus increases the enthalpy of the refrigerant by a constant magnitude, between the upper and lower pressures of the compressor 306. The pressure and temperature difference (e.g., an operational range) between the heat exchangers 308, 312 is set by the upper and lower pressures of the compressor 306 in a standard heating and cooling refrigeration cycle. However, the operational range between the heat exchangers 308, 312 can be expanded by using the ejector 332 arrangement described. For example, the outdoor heat exchanger 308 can be operated at a lower pressure (and hence at a lower temperature) than the pressure of the flow 349 into the compressor 306, because the ejector 332 will maintain the needed pressure of the flow 349 by blending the flows 331, 347 in the manner previously described. Similarly, the operational range between the heat exchangers 308, 312 can be even further expanded by using the vapor injection line 339 described. In particular, the ejector 332 can be set to output an even lower pressure and temperature to the compressor 306, because the vapor injection flow 341 can be used within the compressor 306 to increase the enthalpy of the refrigerant being compressed therein. By lowering the operational pressure and temperature of the outdoor heat exchanger 308, greater enthalpy gains are achieved as more heat energy is absorbed by the refrigerant. Additionally, a lower temperature for the outdoor heat exchanger 308 also allows the use of the heat pump HVAC system 300 in colder environments because heat transfer is still possible when the outdoor heat exchanger 308 is colder than the outdoor ambient temperature. In an example, the heat pump HVAC system 300 is classified as a CCHP, where the outdoor heat exchanger 308 has an operational range down to at least 5 F (−15 C) ambient temperature. Alternatively, the heat pump HVAC system 300 is a CCHP, where the outdoor heat exchanger 308 has an operational range down to at least −15 F (−26 C) ambient temperature.

Figure 9:
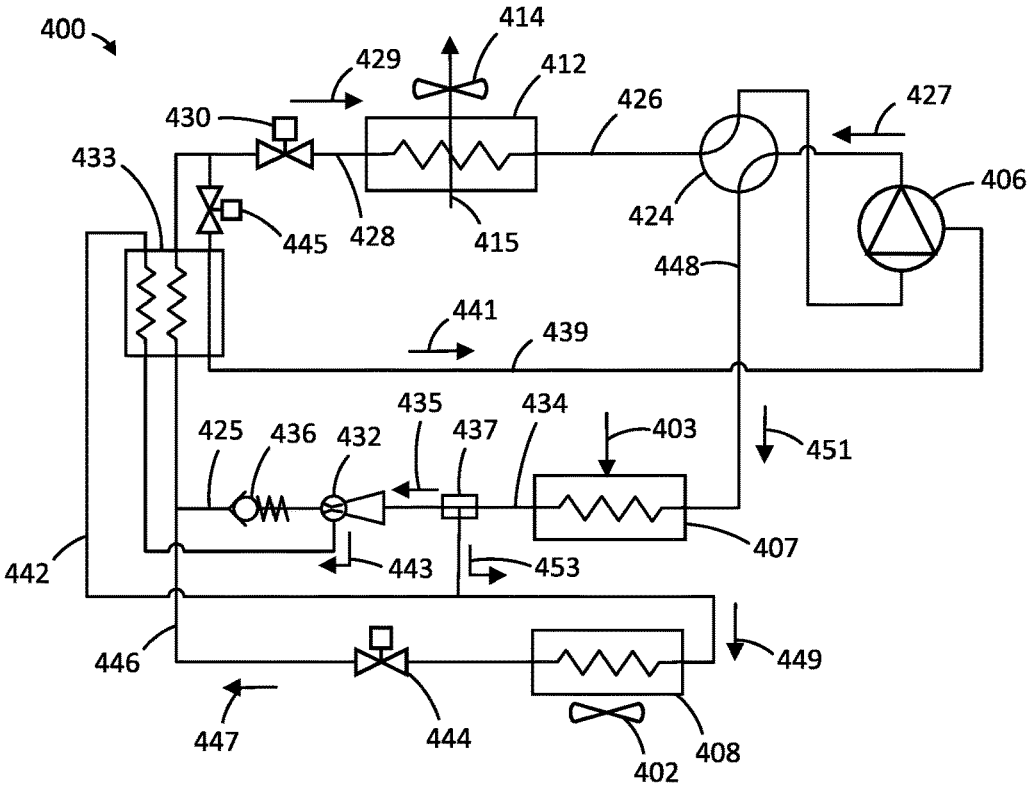
FIG. 9 is a schematic view of a heat pump HVAC system in a cooling mode of operation, according to one or more embodiments.
Figure 10:
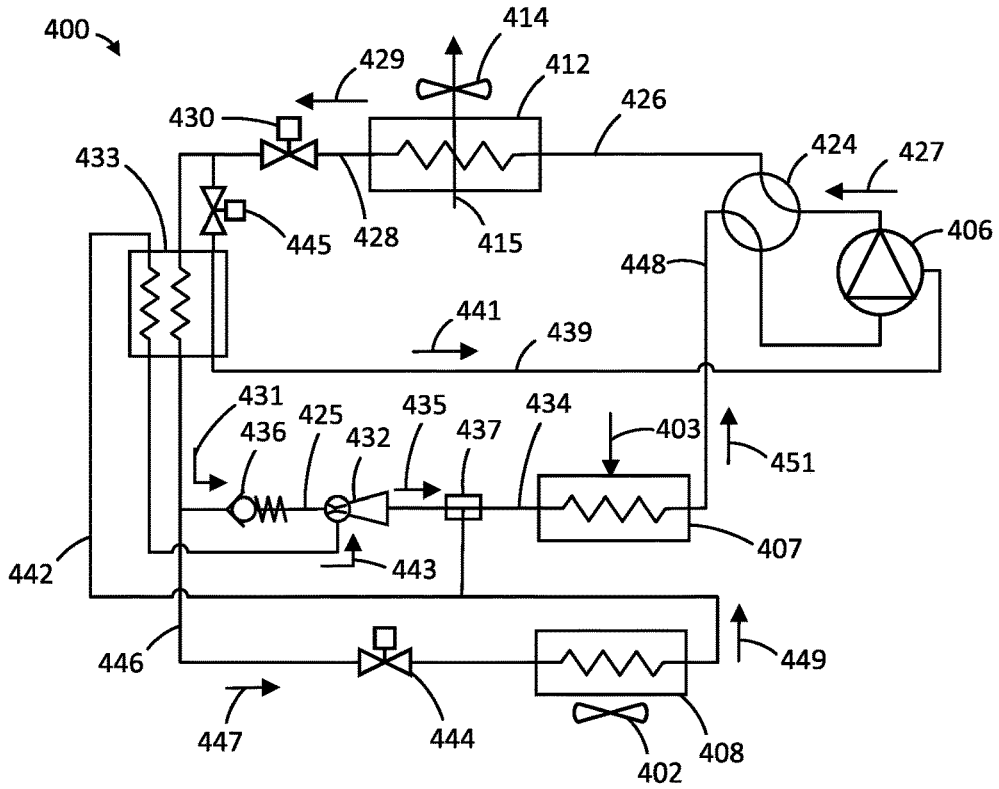
FIG. 10 is a schematic view of the heat pump HVAC system of FIG. 9 in a heating mode of operation.

FIGS. 9 and 10 depict a heat pump HVAC system 400. In general, when in a cooling mode and a heating mode of operation, the refrigerant circuit circulates the refrigerant to perform a vapor compression refrigeration cycle, whereby heat is exchanged at the indoor heat exchanger 412, an offset heat exchanger 407, and an outdoor heat exchanger 408. The direction of heat transfer for the heat exchangers 412, 407, 408 is reversed between the cooling and heating modes of operation. In general, some components and the refrigeration circuit of the heat pump HVAC system 400 are similar to the components and refrigerant circuit of the heat pump HVAC system 200, and thus the same or similar reference numerals are used. Accordingly, such features will not be described again in detail, except as necessary for the understanding of the heat pump HVAC system 400. As described further herein the heat pump HVAC system 400 includes an internal heat exchanger 433 that is used in the cooling and heating modes to transfer heat into a vapor injection line 439 and to a compressor 406. In addition, the internal heat exchanger 433 may also be configured, in the heating mode, to transfer heat between a line 442 and a line 446, which leads into an ejector 432.

The heat pump HVAC system 400 of FIG. 9 depicts a cooling mode of operation. The refrigerant circuit of the heat pump HVAC system 400 recirculates a refrigerant between the indoor heat exchanger 312 and the outdoor heat exchanger 308. The refrigerant circuit includes the compressor 406, a configurable four-way valve 424, the indoor heat exchanger 412, an optional expansion device 430, the ejector 432, a check valve 436, an optional three-way valve 437, the offset heat exchanger 407, an expansion device 444, the outdoor heat exchanger 408, and various lines as detailed herein to connect the components of the refrigerant circuit. In a cooling mode, the refrigerant is compressed by the compressor 406 to increase a pressure and an enthalpy of the refrigerant. A flow 427 of the compressed refrigerant is sent through the four-way valve 424, through a line 448 via a flow 451 and to the offset heat exchanger 407.

The flow of the refrigerant within the offset heat exchanger 407 exchanges heat with the outdoor environment via an outdoor airflow 403 established by an outdoor fan 402. In the cooling mode, the refrigerant within the offset heat exchanger 407 is hotter than the outdoor environment and thus heat is transferred away from the refrigerant and the enthalpy of the refrigerant is reduced as part of the vapor compression cycle. After the offset heat exchanger 407, the refrigerant is sent through a line 434 via the flow 435 to the ejector 432 and then into a line 442 via a flow 443 out of the ejector 432. The flows 435, 443 are substantially equal as the ejector 432 may be configured to not substantially restrict or change the pressure or velocity between the flows 435, 443.

The line 442 passes through the internal heat exchanger 433, and is thermally coupled to the line 446 as discussed further below. The lines 442, 446 are thermally coupled by the internal heat exchanger 433 (e.g., by using counter flow, parallel flow, or combinations thereof through a common thermally conductive material) such that heat may be transferred therebetween. During the cooling mode of operation, the temperatures of the lines 442, 446 are higher than the vapor injection line 439, thus heat may be transferred into the vapor injection line 439. The ejector 432 is also connected to the refrigerant circuit at a third position via a line 425, however the check valve 436 restricts flow along the line 425, thus the flow 435 is directed into the flow 443. Optionally, the three-way valve 437 may be included along the line 434 to direct a bypass flow 453 of the refrigerant to the line 442, while blocking the flow 435, and thus bypassing the ejector 432. The refrigerant within the line 442 passes through the outdoor heat exchanger 408 as shown by a flow 449 and exchanges heat with the outdoor airflow 403. As heat energy is removed from the refrigerant, the enthalpy of the refrigerant is further reduced. Furthermore, if the on/off three-way valve 437 is present, the check valve 436 may be omitted.

The expansion device 444 installed along the line 446 then expands refrigerant, causing a reduced pressure, a reduced temperature, and an associated increased flow rate as shown by a flow 447 downstream of the expansion device 444. The expanded and cooled refrigerant of the flow 447 then passes through the internal heat exchanger 433. The temperature of the flow 447 within the line 446 is less than the temperature of the flow 443 in the line 442 and thus heat and enthalpy are transferred into the flow 447. Therefore, the heat exchange by the internal heat exchanger 433 also cools (e.g., "precools") the flow 431 of refrigerant in the line 425 before the refrigerant enters the ejector 432. The optional expansion device 430, is fully open in the cooling mode and thus does not change the velocity or pressure of the refrigerant flowing therein. Alternatively, the expansion device 444 may be fully open in the cooling mode and instead the expansion device 430 is used to expand the refrigerant passing along the line 446 as the flow 447. When the expansions device 444 is fully open, the temperature of the refrigerant within the line 446 will be greater than when the expansion device 444 is partially closes and thus the internal heat exchanger 433 will have more heat to transfer into the refrigerant within the vapor injection line 439. Additionally, when the expansions device 444 is fully open, the expansion device 430 is used to expand the refrigerant, causing a reduced pressure, a reduced temperature, and an associated increased refrigerant volumetric flow rate as shown by the flow 429 downstream of the expansion device 430.

The refrigerant continues along a line 428 and as a flow 429 that passes through the indoor heat exchanger 412 to exchange heat with an indoor airflow 415 established by a blower 414. The enthalpy of the refrigerant is increased as it is heated, and the air cooled by the indoor heat exchanger 412 is supplied to the indoor space or environment being conditioned. After the heat exchange at the indoor heat exchanger 412, the refrigerant is evaporated into a gaseous state and then travels back through a line 426, through the four-way valve 424, and is then sucked back into the compressor 406 to repeat the cycle.

Optionally, the expansion device 444 or the expansion device 430 can be replaced by two unidirectional expansion devices, one dedicated to a cooling mode of operation and the other to a heating mode of operation. Also optionally, a vapor line expansion device 445 may also be coupled to the line 439 and the line 439 is coupled to the line 446 at a position upstream of the expansion device 430. When the vapor line expansion device 445 is opened, the refrigerant from the line 446 is reduced in pressure and temperature as the refrigerant is expanded into a vapor injection flow 441 via a vapor injection line 439. The vapor injection line 439 is thermally coupled with the lines 442, 446 via the internal heat exchanger 433 and thus heat is transferred between lines 442, 446 and the vapor injection line 439. The vapor injection flow 441 is then supplied to the compressor 406 for internal mixing with the flow 429 of refrigerant downstream of the indoor heat exchanger 412. The enthalpy of the refrigerant of the vapor injection flow 441 is greater than the enthalpy of the refrigerant of the flow 429. Thus, less work input energy is needed by the compressor 406 to return the refrigerant to the initial conditions for the flow 427. In this manner, an operational range between the heat exchangers 408, 412 is expanded as previously described. Optionally, an accumulator (not shown) may be placed between the four-way valve 424 and the compressor 406 to ensure separation of gaseous and liquid phases of the returned refrigerant.

The heat pump HVAC system 400 of FIG. 10 depicts a heating mode of operation. The refrigerant is again compressed by the compressor 406 to increase a pressure and an enthalpy of the refrigerant. The flow 427 of the compressed refrigerant is sent through the four-way valve 424 to the indoor heat exchanger 412 via the line 426. The refrigerant dissipates heat at the indoor heat exchanger 412 to the indoor airflow 415 that is supplied to the indoor space or environment being conditioned. After the heat exchange at the indoor heat exchanger 412, the enthalpy of the refrigerant is decreased, and the refrigerant is sent via the line 428 and the flow 429 to the expansion device 430. The expansion device 430 is optionally fully open in the heating mode of operation or may be omitted. By omitting the expansion device 430, the refrigerant is maintained at a higher temperature and pressure within the line 446 and thus for introduction into the ejector 432. Alternatively, if the expansion device 430 is included, the expansion device 444 may be controlling the refrigerant flow in conjunction with the expansion device 430, in the heating mode of operation. By omitting the expansion device 430 or by configuring the expansion device 430 to be fully open in the heating mode, the temperature of the refrigerant within the line 446 will be greater than when the expansion device 430 is partially closes and thus the internal heat exchanger 433 will have more heat to transfer into the refrigerant within the vapor injection line 439. The pressure within the line 425 is greater than the biased pressure setting of the check valve 436 and a flow 431 is directed along a line 425 to the ejector 432. The biased pressure of the check valve 436 may be set to achieve the desired flow rate of the flow 431 to the ejector 432. Optionally, the expansion device 430 (when included) and the expansion device 444 may be controlled to establish the pressure difference across the check valve 436 and thus control the flow 431 into the ejector 432.

The flow 447 flows the refrigerant through the expansion device 444 that expands the refrigerant and reduces the pressure and temperature of the refrigerant for heat exchange in the outdoor heat exchanger 408 via the outdoor airflow 403 established by the outdoor fan 402. In the heating mode, the refrigerant within the outdoor heat exchanger 408 is colder than the outdoor environment and thus heat is transferred into the refrigerant and the enthalpy is increased. The refrigerant is then transferred in the line 442 as the flow 449 into the internal heat exchanger 433 and the flow 443 into the ejector 432. In the heating mode, the optional three-way valve 437 (when included) is closed to the line 442, and thus substantially all of the flow 449 is directed into the flow 443 and into the ejector 432. Narrowed orifices within the ejector 432 focus and accelerate the flow 431 and reduce the refrigerant pressure within the ejector 432. The pressure of the refrigerant in the flow 443 is less than the pressure of the refrigerant in the flow 431, however the operation of the ejector 432 still allows mixing and combination of the flows 431, 443. As previously described, the accelerated flow and associated pressure drop within the ejector 432 creates a lower pressure within the orifice of the ejector 432 that is used to suck in, entrain, and mix the flows 431, 443. In this manner, the flow 431, which has a relatively higher pressure upstream of the ejector 432, is mixed with the lower pressure flow 443, and a resulting combined flow 435 has a relatively intermediate enthalpy that is between the enthalpy of the flows 431, 443 leading into the ejector 432.

The combined flow 435 then flows through the offset heat exchanger 407 and exchanges heat with the outdoor airflow 403 in the manner described for the outdoor heat exchanger 408. By creating an intermediate enthalpy for the combined flow 435, the flow 451 that returns to the compressor 406 is at a higher enthalpy than it would be if the flow 443 were returned directly to the compressor 406. Thus, by using the ejector 432 as described, the work input energy of the compressor 406 is less to return the enthalpy of the refrigerant to the initial compressed condition, relative to the work input energy required to compress the flow 443 to the initial compressed condition. Optionally, the three-stream internal heat exchanger 433 can be replaced by two two-stream heat exchangers (not shown), one to transfer heat between the refrigerant flows 449 and 447 and the other to transfer heat between the refrigerant flow 447 and the vapor injection flow 441.

As previously described, for a constant amount of compressor 406 work input, a pressure difference between the input (line 448) and the output (line 426) is constant. The compressor 406 operation thus increases the enthalpy of the refrigerant by a constant magnitude, between the upper and lower pressures of the compressor 406. The pressure and temperature difference (e.g., an operational range) between the heat exchangers 408, 412 is set by the upper and lower pressures of the compressor 406 in a standard heating and cooling refrigeration cycle. However, the operational range between the heat exchangers 408, 412 can be expanded by using the ejector 432 arrangement described. For example, the outdoor heat exchanger 408 can be operated at a lower pressure (and hence at a lower temperature) than the pressure of the flow 451 into the compressor 406, because the ejector 432 will maintain the needed pressure of the flow 451 by blending the flows 431, 443 in the manner previously described. Similarly, the operational range between the heat exchangers 408, 412 can be even further expanded by using the vapor injection line 439 described. In particular, the ejector 432 can be set to output an even lower pressure and temperature to the compressor 406, because the vapor injection flow 441 can be used within the compressor 406 to increase the enthalpy of the refrigerant being compressed therein. By lowering the operational pressure and temperature of the outdoor heat exchanger 408, greater enthalpy gains are achieved as more heat energy is absorbed by the refrigerant. Additionally, a lower temperature for the outdoor heat exchanger 408 also allows the use of the heat pump HVAC system 400 in colder environments because heat transfer is still possible when the outdoor heat exchanger 408 is colder than the outdoor ambient temperature. In an example, the heat pump HVAC system 400 is classified as a CCHP, where the outdoor heat exchanger 408 has an operational range down to at least 5 F (−15 C) ambient temperature. Alternatively, the heat pump HVAC system 400 is a CCHP, where the outdoor heat exchanger 408 has an operational range down to at least −15 F (−26 C) ambient temperature.

Figure 11:
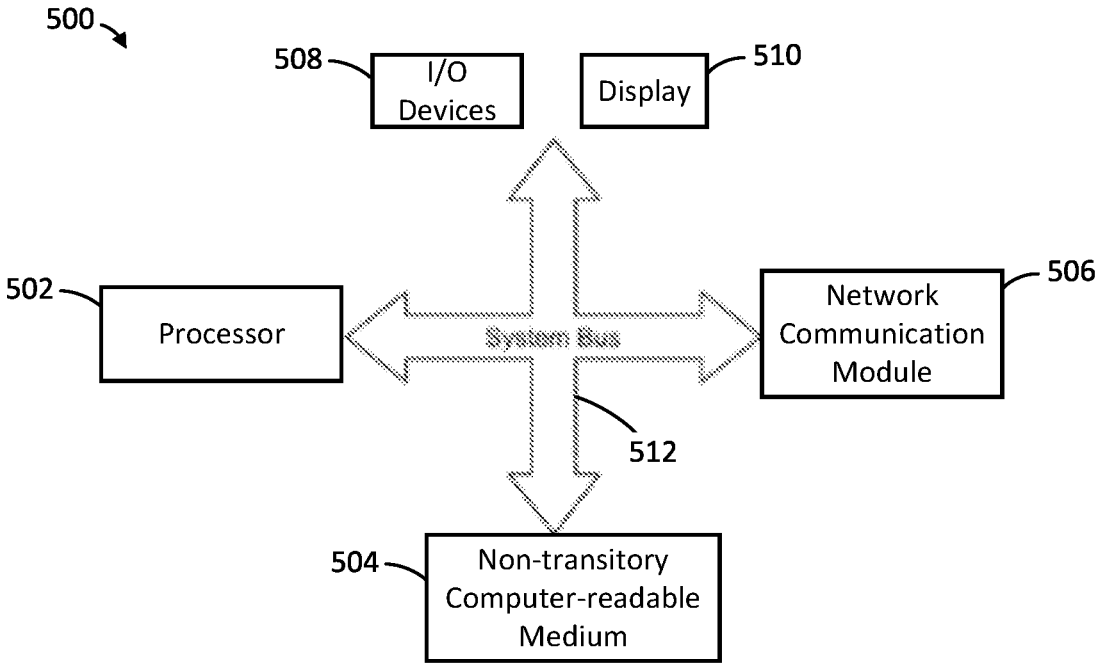
FIG. 11 is a block diagram of a controller, according to one or more embodiments.

FIG. 11 is a block diagram of a controller 500 that can be used to control the blower(s) and the compressor(s) of an HVAC system, such as in the control systems described above. The controller 500 includes at least one processor 502, a non-transitory computer readable medium 504, an optional network communication module 506, optional input/output devices 508, a data storage drive or device, and an optional display 510 all interconnected via a system bus 512. In at least one embodiment, the input/output device 508 and the display 510 may be combined into a single device, such as a touch-screen display. Software instructions executable by the processor 502 for implementing software instructions stored within the controller 500 in accordance with the illustrative embodiments described herein, may be stored in the non-transitory computer readable medium 504 or some other non-transitory computer-readable medium.

The controller 500 may be realized by, for example, a computer. The computer that constitutes the controller 500 may include a control calculation device and a storage device. For the control calculation device, a processor such as a CPU or a GPU may be used. The control calculation device reads a program that is stored in the data storage device and performs a predetermined computing processing operation in accordance with the program. Further, the control calculation device writes a calculated result to the storage device and reads information stored in the storage device in accordance with the program. Alternatively, the controller 500 may be formed by using an integrated circuit (IC) that can perform control similar to the control that is performed by using a CPU. Here, IC includes, for example, LSI (large-scale integrated circuit), ASIC (application-specific integrated circuit), a gate array, and FPGA (field programmable gate array).

Although not explicitly shown in FIG. 11, it should be recognized that the controller 500 may be connected to one or more public and/or private networks via appropriate network connections. It will also be recognized that software instructions may also be loaded into the non-transitory computer readable medium 504 from an appropriate storage media or via wired or wireless means.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can include instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

Optionally, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

Optionally, the expansion devices may be thermostatic expansion valves ("TXV") or electronic expansion valves ("EXV"). TXV valves may be controlled using a temperature sensing bulb and an equalizer line (not shown) that may be connected to the refrigerant circuit at a position downstream of the sensing bulb. The location of the sensing bulb may be selected to optimize vapor compression refrigeration cycle, depending on user preferences for the heat pump HVAC systems. Additionally, the HVAC systems may include an equalization line (not shown) in communication with the pressures in the indoor heat exchanger and the outdoor heat exchanger. In embodiments where the expansion devices are EXV type devices, a pair of temperature or temperature/pressure sensors (not shown) may be connected to a main controller (e.g., controller 500 of FIG. 11) to provide measurement data for the control of the EXV expansion device operation. The temperature and/or pressure sensors are positioned to sense temperature and/or pressure in the compressor suction line and/or the accumulator upstream of the compressor and downstream of the four-way valve. The main controller (e.g., controller 500 of FIG. 11) processes the measurement data and provides control commands to the EXV expansion device to operate the HVAC system.

If an accumulator is used in the compressor suction line (e.g., line downstream from the compressor), the accumulator allows for the collection of some refrigerant, before the refrigerant flows to the compressor. The accumulator provides the benefit of separating some non-vaporized refrigerant before passing to the compressor. Further, the expansion devices may also be configurable to control the flow of refrigerant to store some refrigerant in the accumulator if there is a refrigerant charge imbalance in the refrigeration circuit.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of operating a heat pump heating, ventilation, and air conditioning (heat pump HVAC) system operable to use a refrigerant to heat an indoor space in a heating mode or cool an indoor space in a cooling mode, the method comprising:

compressing the refrigerant with a compressor;

flowing the refrigerant in a refrigerant circuit including an indoor heat exchanger, a first expansion device, and an outdoor heat exchanger, wherein the refrigerant flows through the first expansion device in a first direction in the cooling mode and in a second direction, opposite the first direction, in the heating mode;

flowing a first flow of refrigerant upstream from the outdoor heat exchanger in the heating mode;

flowing a second flow of refrigerant downstream from the outdoor heat exchanger in the heating mode;

transferring heat between the first flow and the second flow via an internal heat exchanger to precool the first flow before entering an ejector in the heating mode;

combining the first flow and the second flow into a combined flow within the ejector in the heating mode, wherein the first flow includes lower enthalpy than the second flow, and wherein the combined flow includes an enthalpy between the first flow and the second flow; and flowing at least a portion of the combined flow to the compressor in the heating mode.

2. The method of claim 1, wherein combining of the first flow and the second flow results in the combined flow with an enthalpy between the first flow and the second flow.

3. The method of claim 1, further comprising:

separating a liquid phase of the refrigerant from the first flow of the refrigerant in a separation tank in the heating mode; and flowing the liquid phase of the refrigerant through a second expansion device to expand the first flow in the heating mode.

4. The method of claim 1, further comprising flowing the combined flow from the ejector through an offset heat exchanger in the heating mode.

5. The method of claim 4, further comprising, flowing the refrigerant between the offset heat exchanger and the outdoor heat exchanger via a three-way valve to bypass flowing of refrigerant through the ejector in the cooling mode.

6. The method of claim 4, further comprising operating an outdoor fan to flow an outdoor airflow through the offset heat exchanger and the outdoor heat exchanger.

7. A heat pump heating, ventilation, and air conditioning (heat pump HVAC) system operable to use a refrigerant to heat or cool an indoor space and comprising:

a compressor, an outdoor heat exchanger, an indoor heat exchanger, a first expansion device, and a four-way valve connected together as a refrigerant circuit, the four-way valve configurable to direct the refrigerant flow through the first expansion device in a first direction in a cooling mode and in a second direction, opposite the first direction, in a heating mode;

an ejector in fluid communication with the refrigerant circuit; and an internal heat exchanger thermally coupling a first flow of refrigerant upstream from the outdoor heat exchanger and a second flow of refrigerant downstream from the outdoor heat exchanger when in the heating mode, wherein, when the heat pump HVAC system is in the heating mode, the internal heat exchanger is configurable to transfer heat into the second flow before the second flow enters the ejector, and the ejector is configurable to combine the first flow and the second flow into a combined flow, at least a portion of which is returned to the compressor, wherein the first flow includes lower enthalpy than the second flow, and wherein the combined flow includes an enthalpy between the first flow and the second flow.

8. The heat pump HVAC system of claim 7, wherein the refrigeration circuit further comprises an offset heat exchanger configured to receive the combined flow of refrigerant from the ejector when the refrigerant circuit is in the heating mode.

9. The heat pump HVAC system of claim 7, wherein the refrigeration circuit further comprises a vapor line expansion device connected between the first flow of refrigerant and the compressor via a vapor injection line extending though the internal heat exchanger, wherein the internal heat exchanger is further configured to transfer heat between at least one of the first flow or the second flow and the vapor injection line in at least one of the heating or the cooling modes.

10. The heat pump HVAC system of claim 9, wherein the internal heat exchanger is configured to transfer heat between both the first flow and the second flow and the vapor injection line.

11. The heat pump HVAC system of claim 9, wherein the refrigeration circuit further comprises:

a separation tank configured to divide the combined flow into a liquid phase and a gas phase in the heating mode; and a second expansion device configured to expand the liquid phase of the combined flow.

* * * * *